US006377143B1

(12) United States Patent
Zhou et al.

(10) Patent No.: US 6,377,143 B1
(45) Date of Patent: Apr. 23, 2002

(54) WELD-FREE CONTACT SYSTEM FOR ELECTROMAGNETIC CONTACTORS

(75) Inventors: Xin Zhou, Brookfield; Michael Thomas Little, Milwaukee, both of WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/681,320

(22) Filed: Mar. 16, 2001

(51) Int. Cl.[7] ..... H01H 67/02
(52) U.S. Cl. ..... 335/132; 218/154
(58) Field of Search ..... 335/6, 20, 132, 335/167–176; 218/147, 154, 155; 361/162–170

(56) References Cited

U.S. PATENT DOCUMENTS 4,642,429 A * 2/1987 Mori et al. ..... 218/154
5,451,272 A 9/1995 Uemura et al.
5,754,387 A * 5/1998 Tennies et al. ..... 361/170
5,959,517 A 9/1999 Wieloch et al.
6,064,289 A 5/2000 Wieloch et al.

* cited by examiner

*Primary Examiner*—Lincoln Donovan
(74) *Attorney, Agent, or Firm*—Timothy J. Ziolkowski

(57) ABSTRACT

A system and method for preventing contact weld under various fault current conditions is disclosed. The system includes a contactor having stationary and movable contacts biased towards each other and switchable between an open and closed position. Energization of an electromagnetic coil engages the contacts creating an electric path for current flow through the contactor. Pulse width modulation is used to lower the power to the coil and maintain the contacts in the closed position. The contactor is equipped with safeguards to prevent contact welding. Under low fault currents, welding is prevented by contact material composition. Under intermediate fault currents, the contacts are blown open and remain open using magnetic components until the arc dissipates and the contacts have cooled sufficiently. Under high fault currents, the arrangement causes the contacts to blow open and separate the armature from the coil preventing re-engagement of the contacts until the coil is energized again.

20 Claims, 10 Drawing Sheets

WELD-FREE CONTACT SYSTEM FOR ELECTROMAGNETIC CONTACTORS

BACKGROUND OF THE INVENTION

The present invention relates generally to an electrical switching device, and more particularly to, a method and apparatus to prevent contact welding subsequent to variable fault current conditions in an electromagnetic contactor.

Electromagnetic contactors are used in starter applications to switch on/off a load as well as to protect a load, such as a motor, from current overloading. Contactors are used as electrical switching devices and incorporate fixed and movable contacts that when closed, conduct electric power. Once closed, the contacts are biased toward one another. A well-known problem with contactors having contacts biased together is the welding of the contacts during the occurrence of a short circuit event.

There are several known methods of preventing contact welding in electrical switching devices such as an electromagnetic contactor. One method is the selection of composite materials for the contacts that resist welding under low fault current conditions. Generally, contacts can be blown open due to a magnetic constriction force that is greater than a bias spring force that normally holds the contact closed. An arc forms across the contacts as soon as the contacts part. This arc energy can melt the contact surface and when the contacts re-close when the bias spring force exceeds the dissipating constriction force before current zero, the contacts can weld together. The contacts blow open even at low fault currents, but they do not form weld or only extremely light weld due to weld resistance of the contact material. Due to the chemical composition and the physical structure, composite contact materials can prevent welding of the contacts, and in some cases, can withstand light welding during low fault current events. These light welds can easily be broken by the opening force of the contactors when switched open.

Another method available for intermediate fault current conditions incorporates magnetic components within a contact carrier wherein the magnetic components are in operable association with the contact carrier to keep the contacts apart for a period of time after a fault. Because of the low thermal resistances and high melting points, the contact materials solidify rapidly after melting due to rapid cooling by convection, radiation and conduction. Thus, preventing contact closure for a short time duration after passage of the arc current through the contacts can provide sufficient time for the contacts to harden and not weld together. Such prior art devices disclose magnetic components that influence the biasing forces on the contacts thereby delaying the time of contact closure to permit cooling of the surfaces of the contacts.

Another method of assisting in preventing contact welding is through forced opening of the contactors under high fault currents. A short circuit fault current generates extremely high arc pressure across the contact surfaces in the contactor. This arc pressure can be directed to overcome the magnetic force generated by the armature and the magnetic coil to open the contactor.

Each of the above mentioned methods for the prevention of contact welding have certain drawbacks and limitations. For example, utilizing a contact material that is resistant to welding is feasible during low fault current conditions, but not intermediate to high fault currents. Under intermediate fault currents, magnetic components can be utilized to provide additional time after current zero before contact re-closing, however, often reduced space requirements for the contactor require smaller magnetic components for the magnetic latching function resulting in a saturation effect at fault currents well below a peak current value. The saturation effect causes the magnetic force created by the magnetic components to increase linearly instead of exponentially, which limits the effectiveness of the magnetic latching to prevent contact welding. Likewise, blow open during high fault currents, combined with the increased force created by the biasing spring when further compressed, closes the contacts before the contacts have been cooled sufficiently, thereby causing the contacts to weld together.

Therefore, it would be desirable to have an electromagnetic contactor capable of withstanding a myriad of fault currents that is adaptable for various physical dimensions of the contactor. Such a contactor would prevent welding of the contacts under low fault current conditions, intermediate fault current conditions, and high fault current conditions.

SUMMARY OF THE INVENTION

The present invention provides a system and method of preventing welding between the movable and stationary contacts in an electromagnetic contactor that overcomes the aforementioned drawbacks and provides a device that operates within a wide range of fault current values. The contactor prevents welding of the contacts under low fault current conditions by fabrication of the contacts using a weld resistant material, under intermediate fault current conditions by utilization of magnetic components to temporarily latch the contacts in an open position until the fault current dissipates and the contacts solidify, and under high fault current conditions by preventing the contacts from re-closing upon themselves until the contactor is reset.

The invention includes a contactor having stationary and movable contacts biased towards each other and switchable between an open and a closed position. Energization of an electromagnetic coil engages the contacts creating an electric path for current flow through the contactor. An electromagnetic coil is used that allows the use of a lower holding power once engaged. The invention uses pulse modulation after the contactor is initially engaged to maintain the contactor in a closed position. The contacts may be disengaged and then reset to a contact closed position by spring biasing under low and intermediate fault current conditions, without contact welding with the use of specialized contact material and with the use of magnetic components to compensate for low and intermediate fault currents, respectively. A high fault current creates a blow open effect wherein the armature separates from the electromagnetic coil and disengages the stationary and movable contacts permanently until application of a second energizing pulse to the electromagnetic coil at or above an activation threshold level.

In accordance with one aspect of the present invention, a contactor comprising a contactor housing with stationary contacts mounted within the housing and a contact bridge having movable contacts mounted to the bridge is disclosed. A movable contact carrier is slidably mounted within the contactor housing and has a biasing mechanism between the contact bridge and the movable contact carrier to bias the contact bridge and the movable contacts toward the stationary contacts. An armature is secured to the movable contact carrier and drawn into an electromagnetic coil mounted in the contactor housing thereby closing the movable contacts onto the stationary contacts when the coil is energized by a first energy source. A second energy source, lower than the first energy source, maintains the armature within the electromagnetic coil until released or the occurrence of a high fault current. A high fault current creates a high arc pressure across the contacts within an arc pressure containment mechanism situated about the stationary and movable contacts to disengage the armature from the electromagnetic coil and open the movable contacts from the stationary contacts until the first energy source is reapplied to the electromagnetic coil.

Yet another aspect of the present invention includes a variable fault current tolerable contactor comprising a contactor housing with a stationary contact therein and a contact carrier movable within the contactor housing. A movable contact mounted within the movable contact carrier and in operable association with the stationary contact is switchable between an open position and a closed position, and while in the closed position, allows electrical current to flow through the stationary and movable contacts. An armature is attached to the movable contact carrier and a movable contact biasing mechanism is located between an upper enclosure of the movable contact carrier and the movable contact to bias the movable contact toward the stationary contact. An armature biasing mechanism is located between the armature and a base portion of the contactor housing to bias the armature towards the stationary contact. An electromagnetic coil is mounted in the contactor housing. The coil has an activation power threshold that once attained attracts the armature into the coil thereby engaging the movable contact with the stationary contact, and a reduced holding power threshold to maintain engagement of the contacts thereafter. Under a high fault current, an arrangement is provided wherein the reduced power threshold is overcome to disengage the armature from the electromagnetic coil to open the contacts until regeneration of the activation power threshold. The contactor then stays open until reset with an energizing pulse.

According to another aspect of the invention, a method to prevent contact weld is disclosed. The method includes providing a pair of contacts comprised of a weld resistant material, wherein the contacts are movable between a closed position and an opened position with respect to the other contact. An electromagnetic coil is energized with a first power source to create an electrical path through the pair of contacts when the contacts are in the closed position. Under intermediate to high fault current conditions, the contacts are opened due to a high constriction force on the surface of the contacts. Under intermediate fault currents, the contacts remain open temporarily after the fault current dissipates to provide sufficient time to cool which thereby prevents a welding of the contacts. By physically varying the distance between two magnetic components, the delay time until contact closure can be adjusted. After a high fault current, the contacts are blown open and remain in an open position until the first energy source is reapplied to the electromagnetic coil to overcome the activation power threshold and draw the contacts together.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention. In the drawings.

DETAILED DESCRIPTION

Figure 1:
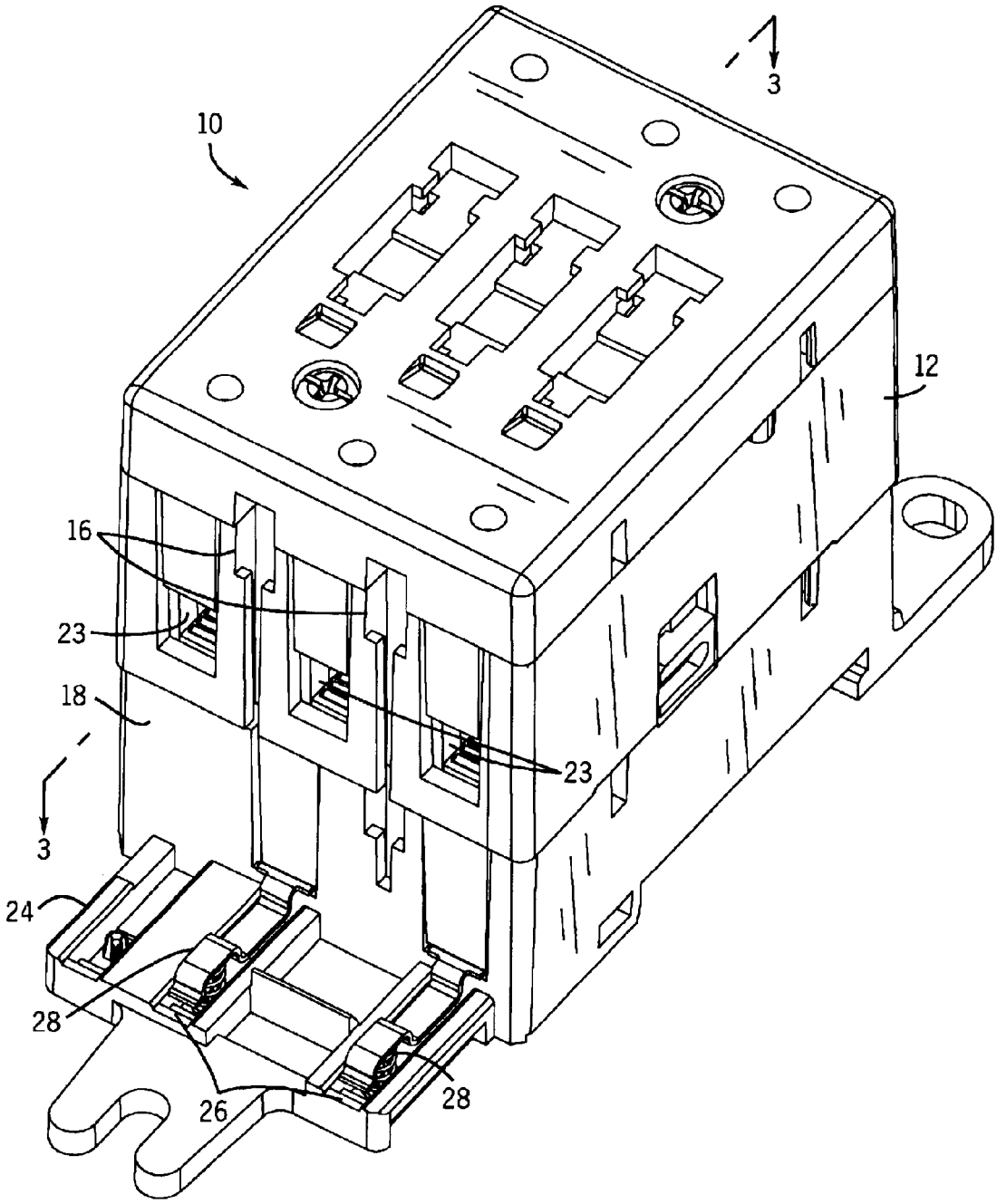
FIG. 1 is a perspective view of a weld-free electromagnetic contactor in accordance with the present invention.

Referring to FIG. 1, a weld-free electromagnetic contactor 10 is shown in perspective view. The weld-free electromagnetic contactor 10 includes an electromagnetic contactor for switching supply current to a motor, as will be described later with reference to FIG. 13. In one embodiment, contactor housing 12 is designed to facilitate connection to an overload relay (not shown) for use in a starter that operates in industrial control applications, such as motor control. Connecting slots 16 within housing wall 18 of electromagnetic contactor 10 are provided to secure such an overload relay to the contactor. Apertures 23 located on housing wall 18 facilitate electrical connection of lead wires to the contactor 10. The contactor 10 includes a platform 24, which is integral with and extends substantially transversely to the plane of contactor wall 18. Platform 24 includes supports 26 for supporting flexible coil terminals 28 which extend outwardly from within the contactor 10. When coupled, the overload relay is placed over the platform 24 to make an electrical connection with flexible coil terminals 28. While the contactor shown is a three pole contactor, the present invention is not so limited.

Figure 2:
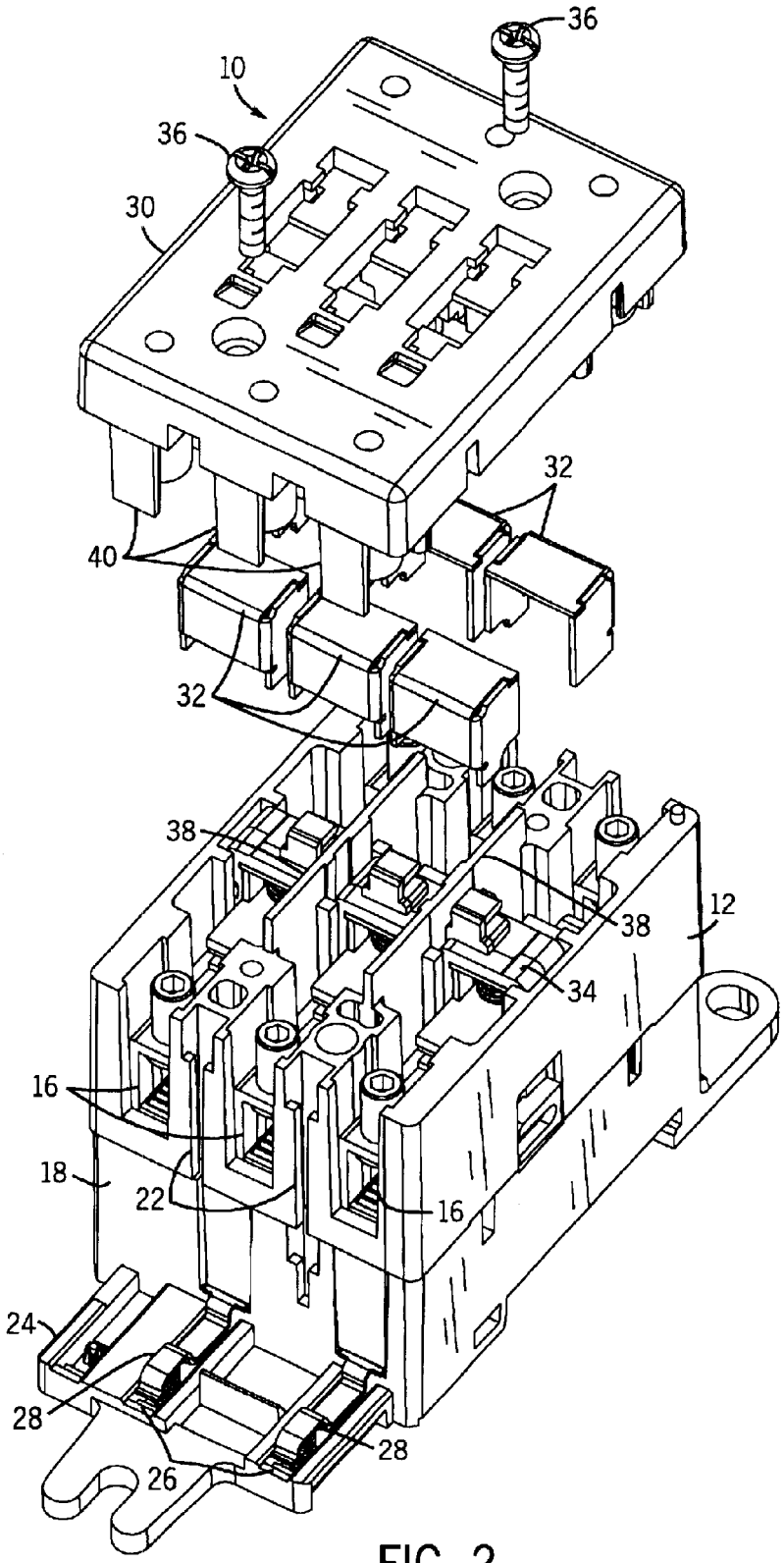
FIG. 2 is an exploded perspective view of the contactor of FIG. 1 with the cover and arc shields removed displaying the movable contact carrier and internal components.

Referring to FIG. 2, an exploded perspective view of the variable fault current tolerable contactor 10 is shown with housing cover 30 and a set of arc pressure containment mechanisms or arc shields 32 removed to display a contact carrier assembly 34. Screws 36 secure the housing cover 30 to the contactor housing 12. The contact carrier assembly 34 is slidably mounted in the contactor housing 12. A pair of interior housing guide walls 38 provides a stopping mechanism for the contactor carrier assembly 34 in the event of a high fault current, as will be described hereinafter. Guide tabs 40 facilitate proper alignment of the housing cover 30 during attachment to the contactor 10.

The arc shields 32 enclose each set of contacts to contain any generated electrical arcs and gases resulting therefrom within the confines of the arc shields. The presence of the arc shields 32 also protects the plastic housing and attracts any arc between the contacts. In a preferred embodiment, arc pressure is contained by a pair of arc shields 32 secured to the contactor housing 12 to surround each set of contacts, for a total of six arc shields in a three-pole contactor.

Figure 2A:
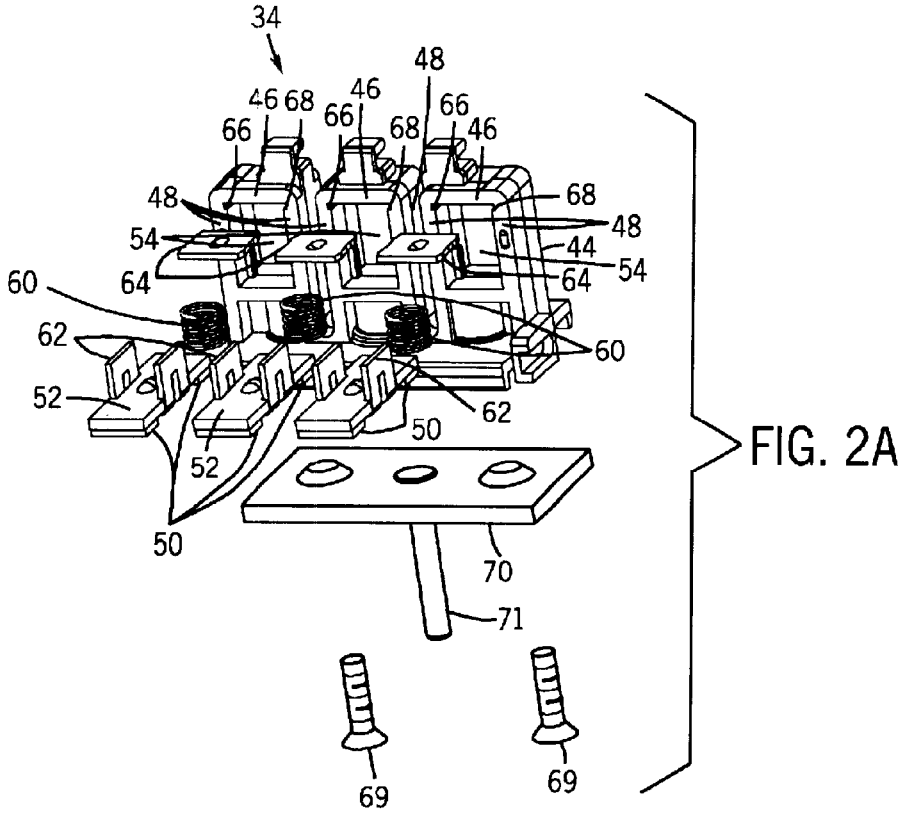
FIG. 2A is an exploded perspective view of a portion of the contactor of FIG. 2.
Figure 6:
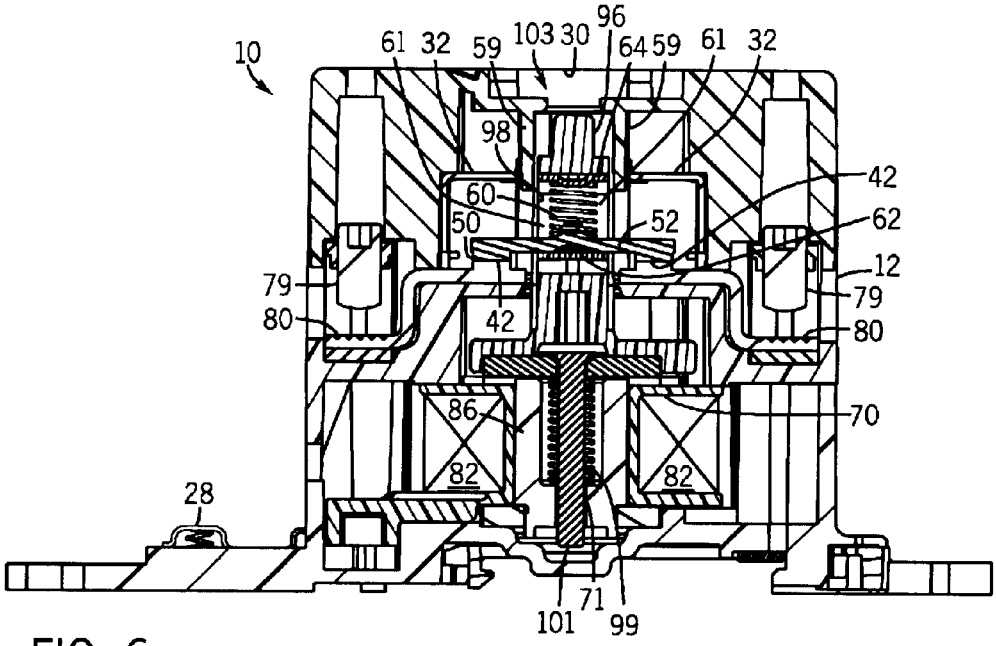
FIG. 6 is a view similar to FIG. 4 showing the contactor in a closed position under normal operating conditions after energization of the electromagnetic coil.

Referring to FIG. 2A, an exploded view of the contact carrier assembly 34 is displayed. The contact carrier assembly 34 has a movable contact carrier 44, which in turn has three upper enclosures 46 having pairs of upwardly extending sides 48. The contact carrier assembly 34 is constructed to be movably mounted within the contactor housing 12 of FIG. 2. The movable contact carrier 44 and the contacts are switchable between a contact open unenergized state and a contact closed energized state. The closed state permits the flow of electric current between a set of movable contacts 50 in operable association with a set of stationary contacts 42 in a well-known manner. Each set of movable contacts 50 is mounted to a contact bridge 52 that travels in windows 54 of the movable contact carrier 44. The movable contacts 50 and contact bridges 52 are biased against the set of stationary contacts 42 when in a contact closed position, as best shown in FIG. 6, by biasing mechanisms or springs 60 situated between the upper enclosures 46 of the movable contact carrier 44 and the contact bridges 52 supporting the movable contacts 50.

Still referring to FIG. 2A, a first magnetic component 62 is located about each contact bridge 52 and is positioned between the bridges 52 and a lower surface of windows 54 when assembled. The first magnetic components 62 are slidably movable with the movable contacts 50 and the contact bridges 52 in an upward direction towards the upper enclosure 46. A set of second magnetic components 64 are fixably mounted in the upwardly extending sides 48 between the movable contacts 50 and the upper enclosures 46 a given distance away from the first magnetic components 62 when the movable contacts 50 are in a contact closed position. Each of the upwardly extending sides 48 in the movable contact carrier 44 have slots 66, 68 to receive and fixably retain the second magnetic components 64 therein. A pair of screws 69 secures an armature 70 to the movable contact carrier 44. A guide pin 71 is attached to the armature 70, as will be explained more fully with reference to FIG. 4.

Figure 3:
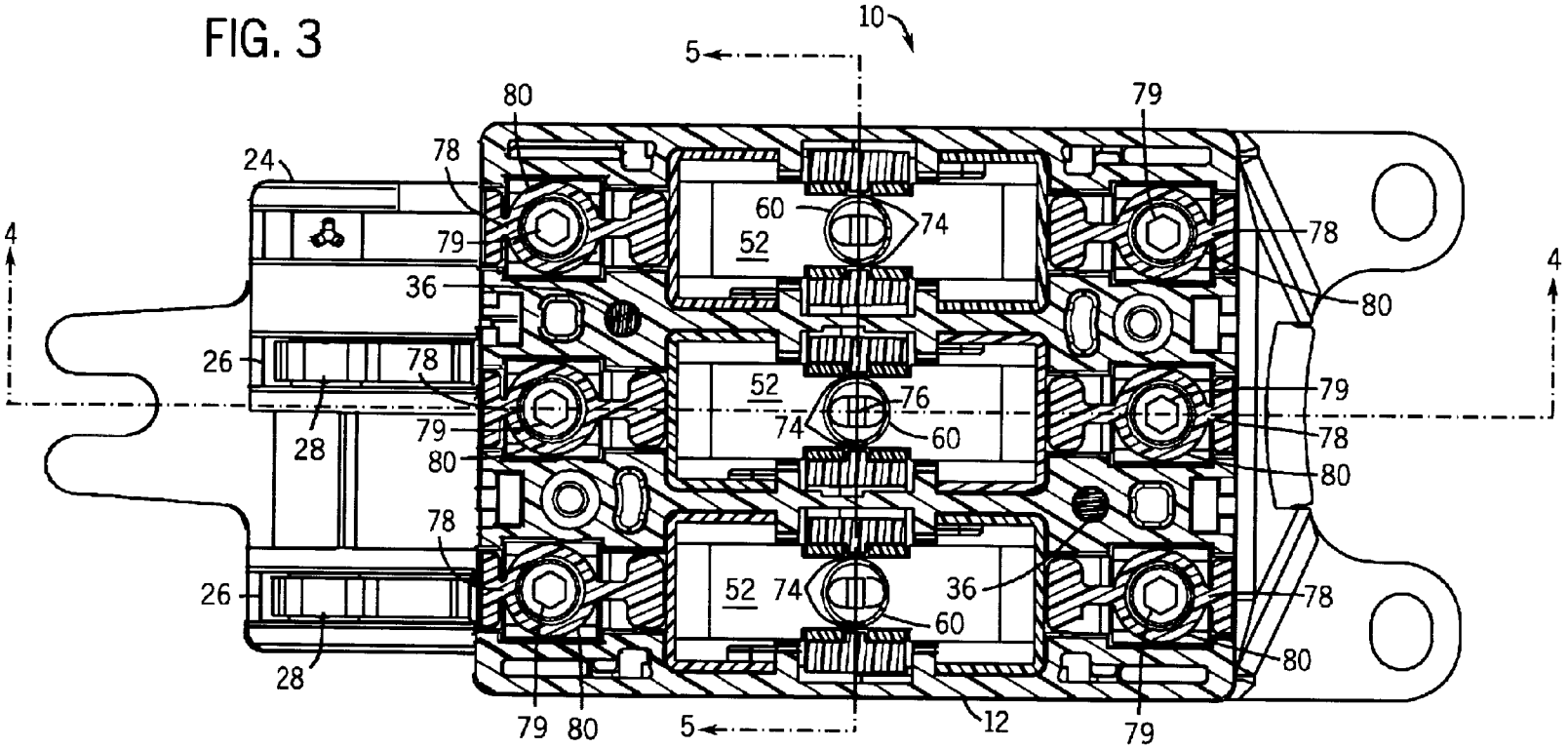
FIG. 3 is a top plan view of the contactor taken along line 3—3 of FIG. 1.

Referring to FIG. 3, a top plan view along line 3—3 of FIG. 1 of the weld-free variable fault current contactor 10 is shown with the housing cover removed. Screws 36 for the housing cover are diametrically opposed from a center position 76 of the contactor 10 to facilitate closure of the housing cover to the contactor housing 12. Each of the contact bridges 52 are in parallel alignment and have contact biasing springs 60 centrally located thereon. The biasing springs 60 are secured to the movable contact carrier and bias the movable contacts against the stationary contacts. Wire leads (not shown) enter the contactor housing 12 via housing apertures 23 and are secured via lugs 79 to conductors 80. The conductors 80 facilitate the flow of electric current through the contactor 10 when the contacts 42, 50 are in a closed position.

Figure 4:
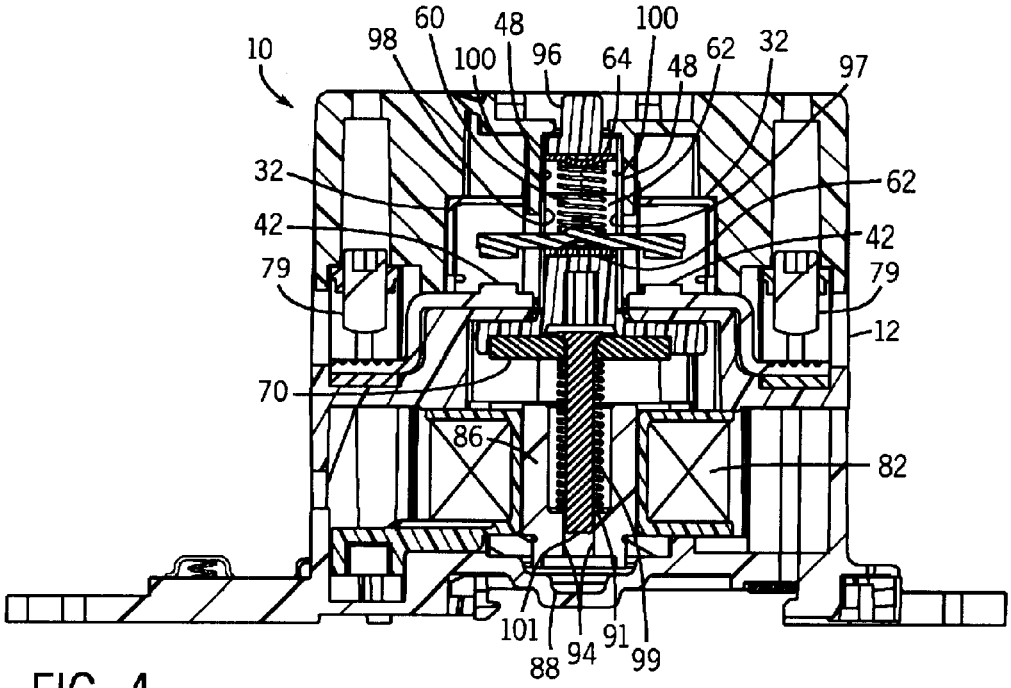
FIG. 4 is a longitudinal cross-sectional view of the contactor taken along line 4—4 of FIG. 3 with the contactor in a normally open position prior to energization of the electromagnetic coil.

Referring now to FIG. 4, a longitudinal cross-sectional view of the contactor 10 taken along line 4—4 of FIG. 3 is shown. The contactor 10 is shown in a normally open operating position prior to energization of an electromagnetic coil 82 with the contacts 42, 50 separated and open. The electromagnetic coil 82 is secured to the contactor housing 12 and is designed to receive an initial first energy source or an in-rush pulse at or above an activation power threshold that draws the armature 70 into the electromagnetic coil 82. The movable contact carrier, secured to the armature 70, is also drawn towards the electromagnetic coil 82. The movable contacts 50, which are biased by spring 60 towards the stationary contacts 42, are now positioned to close upon the stationary contacts 42 and provide a current path. After energization of the electromagnetic coil 82, a second energy source, such as a PWM holding current, lower than the first energy source, is provided to the coil 82. The second energy source is at or above a reduced holding power threshold of the electromagnetic coil and maintains the position of the armature 70 in the coil 82 until removed or a high fault current occurs thereby overcoming the reduced power threshold to disengage the armature from the coil until regeneration of a in-rush pulse that exceeds the activation power threshold. The occurrence of a high fault current and the resulting disengagement of armature 70 causes the opening of the contactor subsequent to the high fault current passing through the contacts 42, 50. Electromagnetic coil 82 includes a magnetic assembly 86 surrounded by coil windings 82 in a conventional manner, and is positioned on a base portion 88 of contactor housing 12. The magnetic assembly 86 is typically a solid iron member. Preferably, electromagnetic coil 82 is driven by direct current and is controlled by a pulse width modulation circuit to limit current after the in-rush pulse, as previously described. When energized, magnetic assembly 86 attracts armature 70 which is connected to movable contact carrier 44. Movable contact carrier 44 along with armature 70 is guided towards the magnetic assembly 86 with guide pin 71.

Guide pin 71 is press-fit or attached securely into armature 70 which is attached to movable contact carrier 44. Guide pin 71 is slidable along guide surface 94 within magnetic assembly 86. The single guide pin 71 is centrally disposed and is utilized in providing a smooth and even path for the armature 70 and movable contact carrier 44 as it travels to and from the magnetic assembly 86. Movable contact carrier 44 is guided at its upper end 96 by the inner walls 97, 98 on the contactor housing 12. Guide pin 71 is partially enclosed by an armature biasing mechanism or a resilient armature return spring 99, which is compressed as the movable contact carrier 44 moves toward the magnetic assembly 86. Armature return spring 99 is positioned between the magnetic assembly 86 and the armature 70 to bias the movable contact carrier 44 and armature 70 away from magnetic assembly 86. A pair of contactor bridge stops 100 limit the movement of the contact bridge 52 towards the arc shields 32 during a high fault current event, as will be discussed more fully with reference to FIG. 12. The combination of the guide pin 71 and the armature return spring 99 promotes even downward motion of the movable contact carrier 44 and assists in preventing tilting or locking that may occur during contact closure. When the moveable contact carrier 44, along with armature 70, is attracted towards the energized magnetic assembly 86, the armature 70 exerts a compressive force against resilient armature return spring 99. Together with guide pin 71, the moveable contact carrier 44 and the armature 70, travel along guide surface 94 in order to provide a substantially even travel path for the moveable contact carrier 44.

Figure 5:
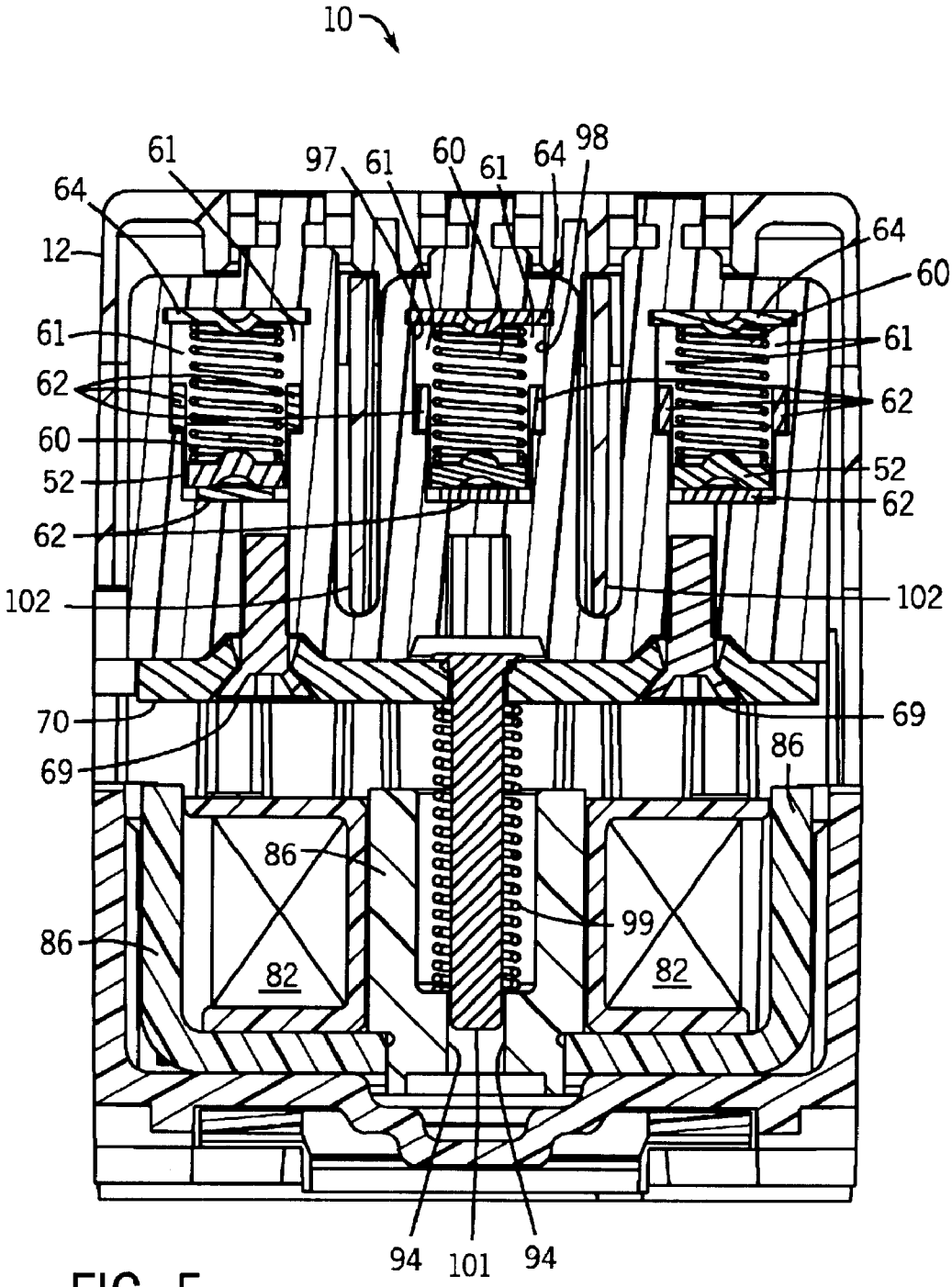
FIG. 5 is a lateral cross-sectional view taken along line 5—5 of FIG. 3 with the contactor in a normally open position prior to energization of the electromagnetic coil.

Referring to FIG. 5, a lateral cross-sectional view of the contactor 10 is depicted in the normal open operating position prior to energization of the electromagnetic coil 82. Initially, the armature 70 is biased by the resilient armature return spring 99 away from the magnetic assembly 86 toward the housing stops 102 resulting in a separation between the armature and core. The contact carrier assembly 34 also travels away from the magnetic assembly 86 due to the armature biasing mechanism 99 which creates a separation between the movable contacts 50 and the stationary contacts 42 preventing the flow of electric current through the contacts 42, 50. Biasing springs 60, located between each of the contact bridges 52 and the second magnetic components 64, are extended to a maximum for each set of contacts 42, 50 resulting in a maximum spacing 61 between the first magnetic component 62 and the second magnetic component 64.

FIG. 6 is a longitudinal cross-sectional view of the contactor 10, similar to FIG. 4, but with the contacts 42, 50 shown in a closed position. The contactor 10 is in a normal closed operating position after energization of the electromagnetic coil 82. The armature 70 is pulled into the electromagnetic coil 82 by the first energy source or an in-rush pulse, and then maintained in the coil by the second energy source, or a PWM holding current. The movable contact carrier 44 is shifted towards the electromagnetic coil 82 causing a spacing, generally referenced as 103, between the upper end 96 of the movable contact carrier 44 and the housing cover 30. Spring 60 is compressed, decreasing the spacing 61 between the magnetic components 62, 64. The contactor housing 12 has the set of stationary contacts 42 mounted on conductors 80. In the closed position, the movable contacts 50 are positioned to conduct electrical current through the stationary contacts 42, the conductors 80, and the contact bridges 52. When in the open position, the current paths are interrupted.

Figure 7:
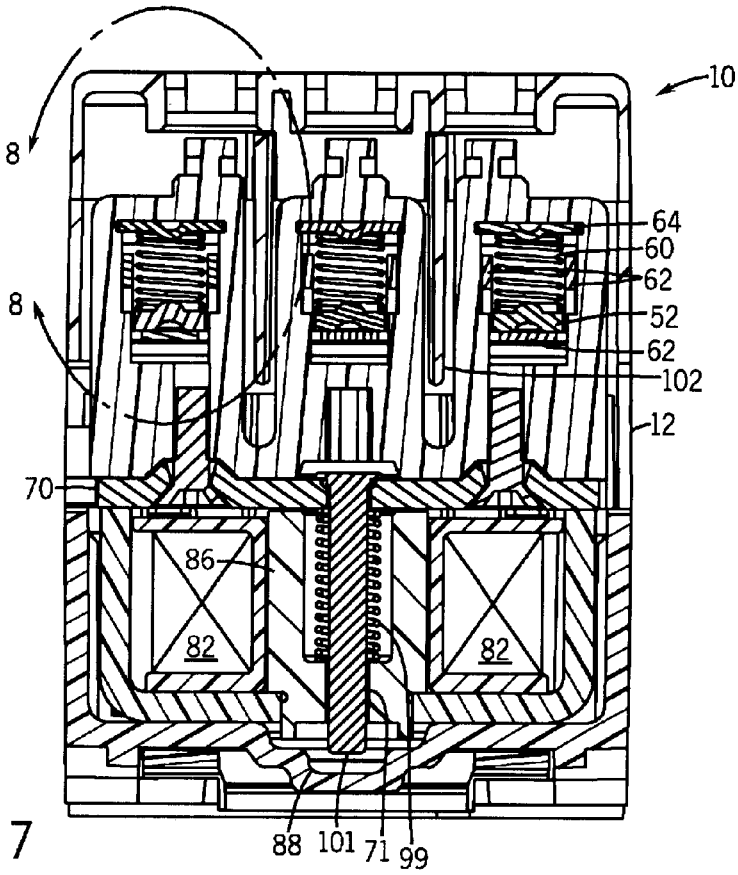
FIG. 7 is a view similar to FIG. 5 under showing the contactor in a closed position under normal operating conditions after energization of the electromagnetic coil.

The contacts 42, 50 are preferably comprised of a silver oxide material to prevent welding of the contacts. Under low fault current conditions, the silver oxide contacts are capable of withstanding arcing with current ranges of up to 2500 to 3000 amps, peak. In one preferred embodiment, the contacts 42, 50 are comprised of a silver tin oxide material to eliminate welding of the contacts under low fault current conditions. In an alternate embodiment, the silver tin oxide material is formed by processing a silver alloy using an internal oxidation treatment or a co-extrusion process. The preferred silver tin oxide material is EMB12 available commercially from Metalor Contacts France SA located in Courville-Sur-Eure, France and having 10% tin oxide ($SnO_2$), 2% bismuth oxide ($Bi_2O_3$) and remainder pure silver (Ag) and trace impurities. In a further embodiment, the contacts 42, 50 can alternatively be comprised of a silver and cadmium oxide material. FIG. 7 is a lateral view of the contactor 10 in the normal closed position under normal operating conditions after energization of the electromagnetic coil 82 with the armature 70 drawn into the coil and maximally spaced away from the housing stops 102. The movable contacts 50 are biased towards the stationary contacts 42 by the movable contact biasing mechanism 60 to maintain closure of the contacts 42, 50 and permit the flow of electric current. The stationary contacts 42 are positioned on the conductors 80 to permit alignment with the movable contacts 50 during closure of the contacts 42, 50. The lowering of guide pin 71 towards the base portion 88 causes the movable contact carrier 44 to move in the same direction as the guide pin 71 and compress the movable contact biasing mechanism 60.

Figure 8:
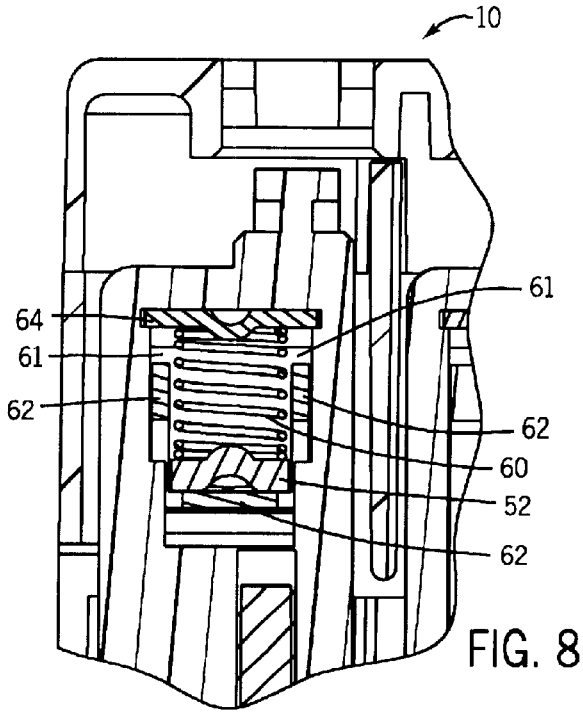
FIG. 8 is an enlarged partial view taken along line 8—8 of FIG. 7 showing the spacing between the magnetic components under normal operating conditions.

FIG. 8 is an enlarged view of a portion of FIG. 7 showing a movable contactor carrier 44 with the magnetic components 62, 64 in the normal closed operating position. Under low fault current conditions, contact welding is deterred by the material of the contacts even though contacts sometimes can be blown open. The material prevents welding at these low fault currents. The spring 60 biases the first magnetic component 62 away from the second magnetic component 64 to create gap 61 therebetween that is at a maximum prior to the initial energization of the electromagnetic coil 82. After the initial energization of the coil 82, the gap 61 decreases due to the compression of spring 60 resulting in the magnetic components 62, 64 moving closer together.

Figure 9:
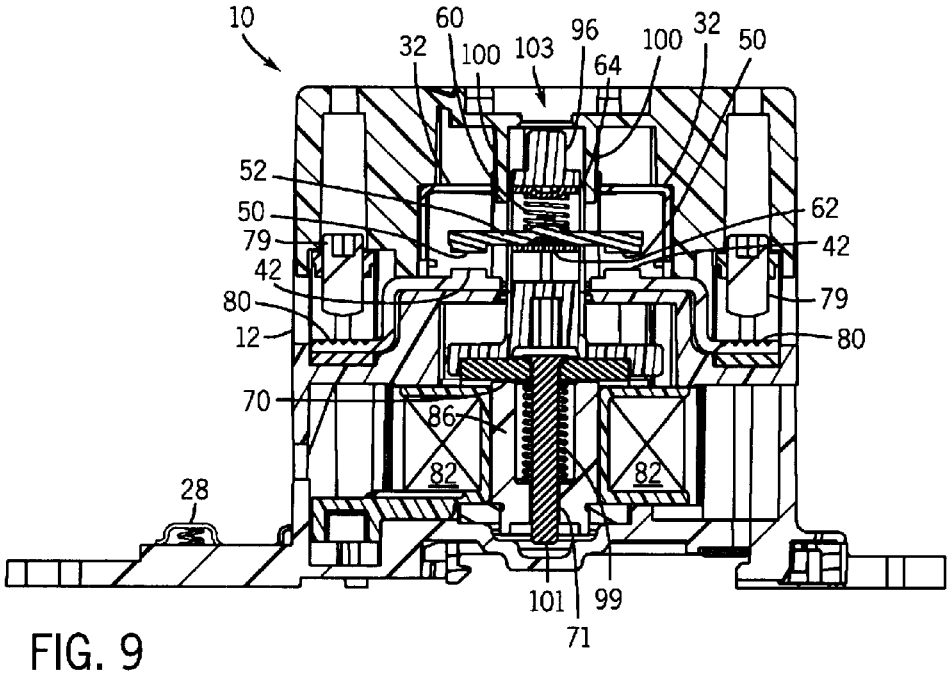
FIG. 9 is a view similar to FIG. 4 after blow-open from an intermediate to high fault current showing the contacts in a latched open position.

Referring now to FIG. 9, a longitudinal cross-sectional view of the contactor 10, similar to FIGS. 4 and 6, is shown under intermediate fault current conditions after energization of the electromagnetic coil 82. Although dependent on contactor size, generally, intermediate fault currents can occur for currents ranging between 3000 to 7500 amps, peak.

An intermediate fault current can generate high constriction forces across the contact surfaces in the contactor 10. Such high constriction forces often overcome the contact biasing mechanism 60 and leads to a blow open of the contacts 42, 50. Armature 70 remains within the electromagnetic coil 82 due to the reduced holding current, which preferably is a pulse width modulated power source. That is, the coil 82 remains energized, but the movable contacts 50 are allowed to "blow open" away from the stationary contacts 42. After being blown open, the contacts 42, 50 are pulled apart and remain apart from each other, in an open position, for a few milliseconds by the magnetic attraction between the magnetic components 62, 64 until reclosure by the biasing mechanism 60 following dissipation of the intermediate fault current after current zero.

Figure 10:
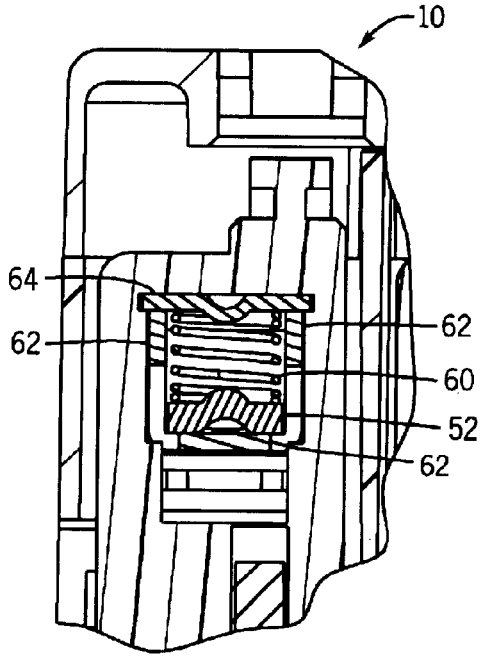
FIG. 10 is a view similar to FIG. 8 wherein the spacing between the magnetic components is at a minimum and the contacts are open.

Referring to FIG. 10, an enlarged view of a portion of FIG. 9, similar to FIG. 8, is shown. After the contacts are blown open due to an intermediate to high fault current, spring 60 is compressed and the gap 61 between the first magnetic component 62 and second magnetic component 64 is minimal. The occurrence of such an arc causes a latching of the magnetic components 62, 64 due to the presence of an increased magnetic force between the magnetic components. Armature 70 remains within the electromagnetic coil 82 and is maintained therein by the reduced holding current. Movable contacts 50 are held open by the magnetic components 62, 64 for a period of time after the fault current dissipates thereby preventing the welding of the contacts 42, 50 during such an intermediate fault current event. This delay time for contact closing after the fault condition is dependent on the time for magnetic field dissipation as well as travel range.

Figure 11:
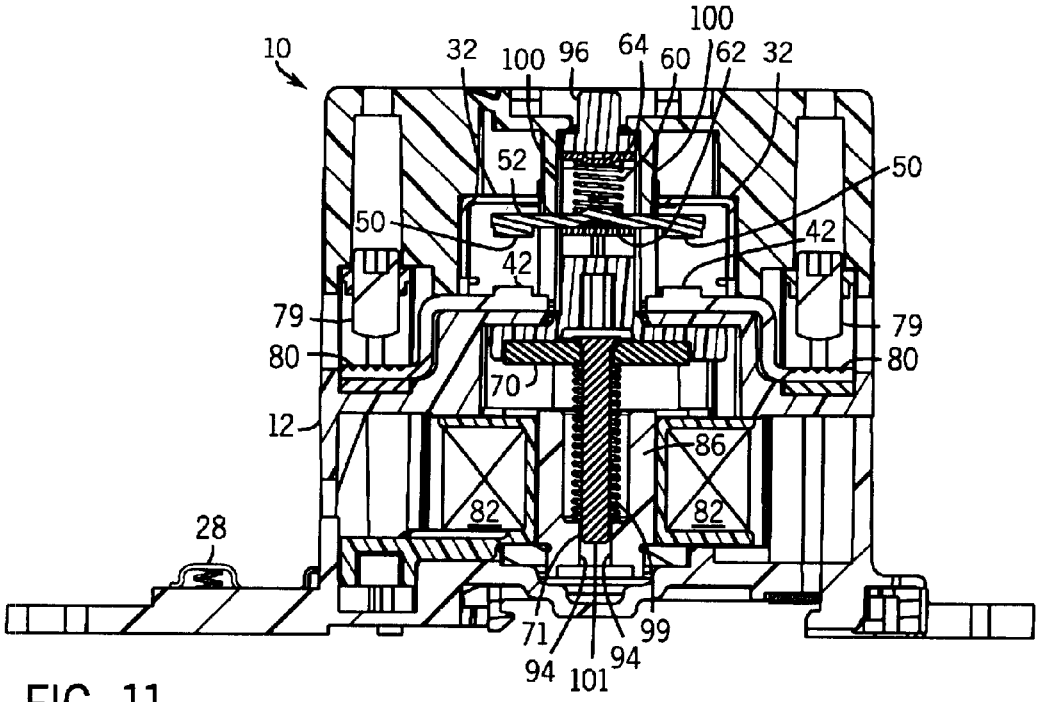
FIG. 11 is a view similar to FIG. 4 after blow open from a high fault current displaying the contacts open and semi-latched.

FIG. 11 is a longitudinal cross-sectional view of the contactor 10, similar to FIGS. 4, 6, and 9, after the contacts have blown open from a high fault current passing through the contacts 42, 50. Arc shields 32 are secured to the contactor housing 12 to thereby essentially enclose the contacts 42, 50 and contain any generated electrical arcs and hot gases as a result of arcing within the confines of the arc shields 32. The contained gases increase pressure within the arc shields 32 until the arc pressure force across the surfaces of the contacts 42, 50 overcomes the biasing mechanism 60 to further separate the contacts. Again, although dependent on the size and application of the contactor, high fault currents typically have current values above 7500 amps, peak. The constriction force and arc pressure generated by high fault currents disengage the contacts 42, 50 and push the movable contacts 50, and the armature 70 away from the electromagnetic coil 82 with such force as to overcome the bias spring force and the attraction force of the electromagnetic coil. This separation is accomplished, at least partially, due to the lower power supplied to the coil after initial energization. Housing stops 102 shown in FIGS. 5 and 7 limit the movement of the armature 70 away from the electromagnetic coil 82. The shifting of the armature 70 away from the electromagnetic coil 82 prevents the contacts 42, 50 from closing upon each other until reapplication of the first energy source.

Figure 12:
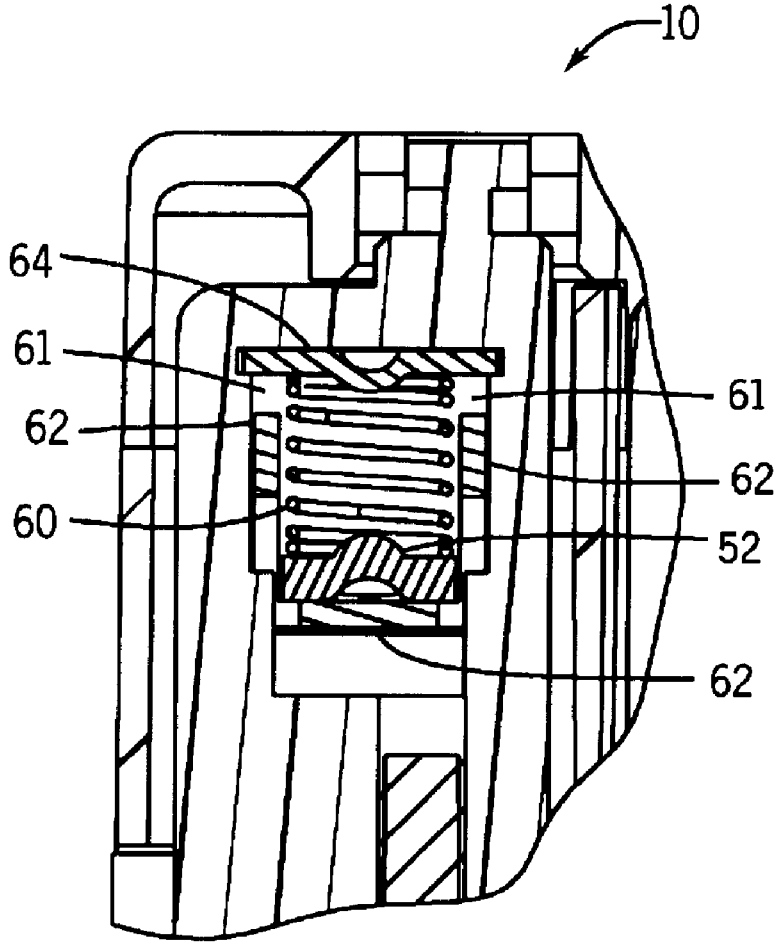
FIG. 12 is a view similar to FIG. 8 after blow open from a high fault current with the contacts open and semi-latched and the magnetic components separated.

FIG. 12 is a detailed view of a contact arrangement as shown in FIG. 11 in a manner similar to FIG. 8 after the occurrence of a high fault current through the contacts 42, 50. After the contacts are blown open, the armature 70 and movable contact carrier 44 are shifted away from the electromagnetic coil 82 preventing further engagement between the contacts 42, 50 until the first energy source is reapplied. That is, the contactor 10 is blown open until manually re-energized. Contact bridge stops 100 limit the movement of the contact bridge 52 away from the electromagnetic coil 82 causing a separation of the magnetic components 62, 64 and a reduction in compression of the biasing mechanism 60. Reapplication of an in-rush pulse draws the armature 70 back into the electromagnetic coil 82 for continued operation of the contactor 10 as previously discussed.

Figure 13:
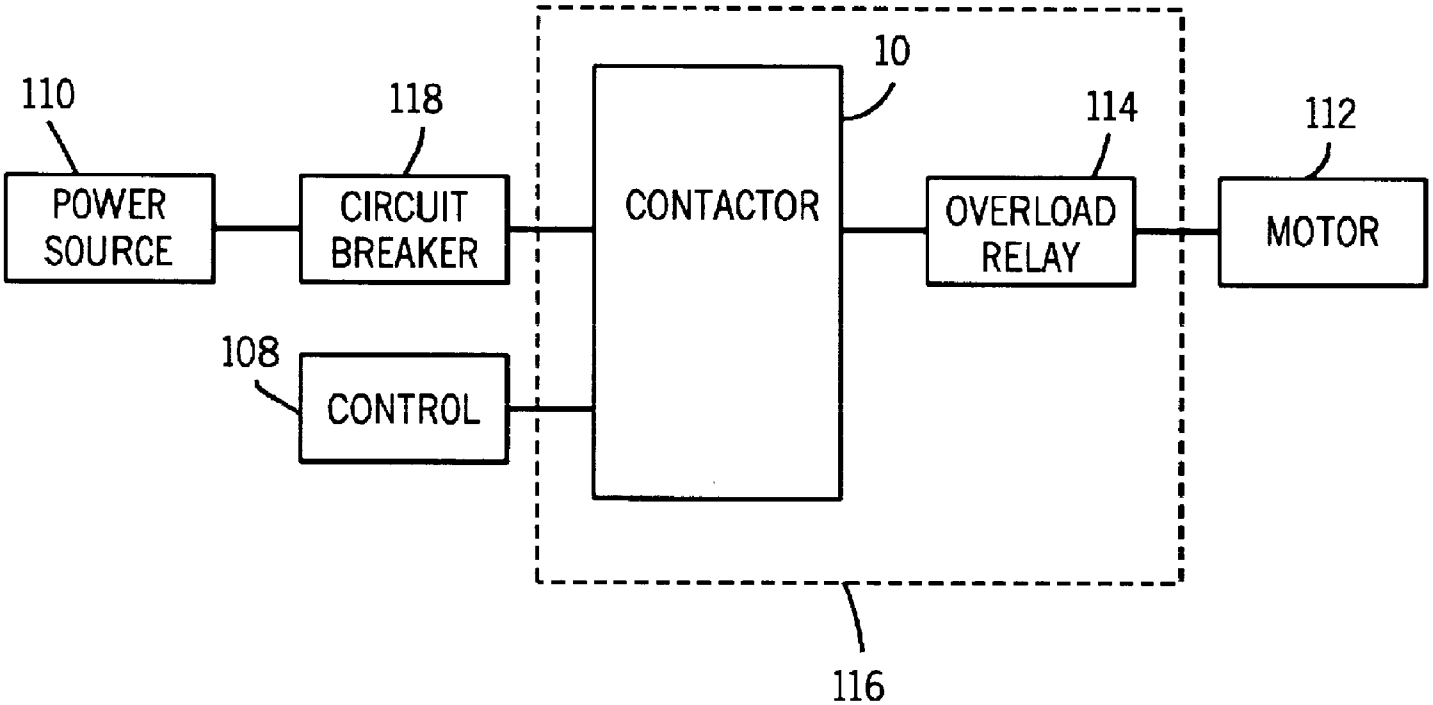
FIG. 13 is a block diagram of a system in accordance with the present invention.

Referring to FIG. 13, a block diagram in accordance with the present invention is shown. Various control circuitry and microprocessors are collectively shown as control 108 to provide DC control utilizing pulse width modulation to the contactor 10. The pulse width is adjustable by the control 108 such that the electromagnetic coil 82 is powered at start-up with an in-rush pulse to draw the armature into the coil 82 and thereafter close the contactor 10. A lower PWM holding current is applied during continued operation to maintain the position of the armature 70. Contactor 10 is designed to open and close a power supply path between the power supply 110 and the motor 112. An overload relay 114 is typically situated between the contactor 10 and the motor 112, which together with the contactor 10, forms a starter 116. A circuit breaker 118 protects the starter 116 and motor 112 from power non-conformities from power source 110.

The operation of the contactor will now be described. A power supply 110 of FIG. 13 generates energy that a controller 108 regulates. An initial first energy source or in-rush pulse, is produced by the control 108 at or above the activation power threshold to energize the electromagnetic coil 82 and cause the armature 70 to be drawn into the electromagnetic coil 82. After the armature 70 is drawn downward into the electromagnetic coil 82, a second energy source, or PWM holding current, at or above a reduced holding power threshold, which is less than the activation power threshold, is generated to maintain the position of the armature 70 within the coil 82. The positioning of the armature 70 in the electromagnetic coil 82 and the biasing mechanism 60 causes the contacts 42, 50 to close.

Under low fault current conditions, the contacts may be blown open and some arcing across contacts may occur. Low fault currents are compensated for by the material of the contacts, which is designed to prevent welding for such low fault current ranges discussed herein. Electrical current can flow through the contactor 10 without the contacts 42, 50 welding together.

Under intermediate to high fault currents, the contacts are blown open, in which the contacts 42, 50 become temporarily disengaged from each other. Magnetic forces generated as a result of the fault current pulls the first magnetic components 62 toward the stationary second magnetic components 64 thereby opening the contacts 42, 50 or assisting the opening during the blow open condition, and then maintaining the contacts open during the fault current condition until the contacts have cooled sufficiently. Again, the contacts 42, 50 are prevented from welding together. In a preferred embodiment, the first magnetic components 62 are U-shaped. However, the second magnetic components 64 could equivalently be U-shaped and the first magnetic components 62 could be U-shaped or planar. Other configurations could be adapted as long as the two magnetic components 62, 64 would be in physically close relationship with one another when the contacts 42, 50 are in an open position causing the magnetic components to be attracted to each other during a fault current event.

In another embodiment, the magnetic components 62, 64 are comprised of a material with a high remnant flux density which allows a longer delay time before the contacts 42, 50 close after current zero. In yet another embodiment, the delay of contact closing can also be adjusted by adjusting the physical gap 61 FIG. 8, between the two magnetic components 62, 64. The magnetic components 62, 64 can include steel plates which have been found to adequately protect the contacts 42, 50 from welding during fault conditions, while at the same time adding minimal cost to the contactor 10 both in terms of component cost and modification cost.

Under high fault current conditions, after the contacts are blown open, the armature 70 and movable contact carrier 44 are shifted away from the electromagnetic coil 82 preventing further engagement between the contacts 42, 50 until the first energy source is reapplied. Prior to the reapplication of the first energy source, electrical current cannot flow through the contactor 10. Once again, the contacts 42, 50 are not welded together. The contact bridge stops 100 limit the movement of the contact bridge 52 away from the electromagnetic coil 82 causing a separation of the magnetic components 62, 64 and a reduction in compression of the biasing mechanism 60.

Accordingly, the invention includes a method of preventing contact weld under various fault current conditions in an electromagnetic contactor. The method includes providing a pair of movable contacts, wherein the movable contacts are movable between a closed position and an opened position with respect to a set of stationary contacts. A pair of magnetic components is provided for keeping the contacts apart for a time after an intermediate fault current. The method includes energizing a coil with a first power source to create an electrical path through the contacts when the contacts are in the closed position. The invention includes separating the contacts to prevent welding of the contacts during intermediate and high fault currents. Once the contacts are opened and the fault dissipates, the invention can also maintain contact separation for a period of time dependent on either the remnant flux associated with the material used for the magnetic components or the physical distance between the magnetic components, as previously described. By physically varying the distance between the magnetic components, the delay time until contact closure can be adjusted by adjusting the gap between the magnetic components. In this manner, the contacts are provided sufficient time to cool before closure which thereby prevents a welding of the contacts. The current through the contacts is thereby also limited during a fault current condition due to a relatively quick opening of the contacts. Also, the contacts are latched open by the magnetic components until after current zero and the contacts are sufficiently cooled. In a high fault current condition, not only are the contacts separated and held open by the magnetic components, but, if the fault current exceeds a given value, the armature is disengaged by the blow open inertial force from the coil and the contactor is thereby opened until another first energy source is applied to draw the armature into the coil and close the contactor.

The present invention has been described in terms of the preferred embodiment, and it is recognized that equivalents, alternatives, and modifications, aside from those expressly stated, are possible and within the scope of the appending claims.

What is claimed is:

1. A contactor comprising:

a contactor housing;

at least one set of stationary contacts mounted within the contactor housing;

a contact bridge having at least one set of movable contacts mounted thereon;

a movable contact carrier slidably mounted within the contactor housing and having the contact bridge movably mounted therein, and having a biasing mechanism between the contact bridge and the movable contact carrier to bias the contact bridge and the movable contacts toward the stationary contacts;

an armature secured to the movable contact carrier;

an electromagnetic coil mounted in the contactor housing and constructed such that when energized with a first energy source, the armature is drawn into the electromagnetic coil to close the movable contacts onto the stationary contacts, and after energized with a second energy source, lower than the first energy source, maintains the armature within the electromagnetic coil; and an arc pressure containment mechanism situated about the stationary and movable contacts such that an occurrence of a high fault current disengages the armature from the electromagnetic coil and opens the movable contacts from the stationary contacts, such that the movable contacts do not re-engage the stationary contacts until the electromagnetic coil is reenergized by the first energy source.

2. The contactor of claim 1 further comprising a control that produces the first energy source to close the contactor and once closed, produces the second energy source, lower than the first energy source, to maintain closure of the contactor.

3. The contactor of claim 2 wherein the control is a pulse width modulation control.

4. The contactor of claim 2 wherein the arc pressure containment mechanism includes an arc shield surrounding the movable and stationary contacts such that arc pressure generated by a high fault current is concentrated within the arc shields and cause the movable contacts and the movable contact carrier away from the stationary contacts with such force as to overcome an attraction force of the electromagnetic coil caused by the second energy source.

5. The contactor of claim 1 wherein the contactor further includes an arc shield secured to the contactor housing to enclose the stationary contacts and facilitate gas containment within the arc shield, thereby increasing pressure under a high arc current to separate the movable contacts from the stationary contacts.

6. The contactor of claim 1 having first and second magnetic components, the first magnetic component located adjacent to and movable with the set of movable contacts and the second magnetic component mounted rigidly to the movable contact carrier such that an intermediate fault current through the contactor generates an attractive magnetic force between the first and second magnetic components causing a temporary separation of the set of movable contacts from the set of stationary contacts.

7. The contactor of claim 6 wherein the contacts automatically reclose only after dissipation of the intermediate fault current at such time that the movable and stationary contacts have cooled sufficiently so as to avoid contact welding.

8. The contactor of claim 6 wherein the first and second magnetic components define therebetween a gap, such that when the contacts are in an open position after the occurrence of an intermediate fault current, the gap between the magnetic components is sufficient to prevent a welding of the magnetic components.

9. The contactor of claim 6 wherein the magnetic components are comprised of a material with a high residual magnetic flux to maintain the contacts in an open position after the fault current dissipates for a given time.

10. The contactor of claim 1 wherein the at least one set of stationary contacts and the at least one set of movable contacts are comprised of one of a silver oxide material, a silver tin oxide material, and a silver cadmium oxide composition.

11. The contactor of claim 10 wherein the silver tin oxide material is formed by subjecting an Ag alloy to an internal oxidation treatment, or a co-extrusion process, and the tin oxide material having approximately 10% tin oxide ($SnO_2$), 2% bismuth oxide ($Bi_2O_3$), and a remainder of silver (Ag) and trace impurities.

12. A variable fault current tolerable contactor comprising:

a contactor housing having at least one stationary contact therein;

a movable contact carrier movable within the contactor housing and having an upper enclosure;

at least one movable contact mounted within the movable contact carrier and in operable association with the stationary contact, the at least one movable contact being switchable between an open position and a closed position, and while in the closed position, allowing electrical current to flow through the stationary and movable contacts;

an armature attached to the movable contact carrier;

a movable contact biasing mechanism located between the upper enclosure of the movable contact carrier and the movable contact to bias the movable contact toward the stationary contact;

an armature biasing mechanism located between the armature and a base portion of the contactor housing to bias the armature towards the stationary contact;

an electromagnetic coil mounted in the contactor housing, the electromagnetic coil having an activation power threshold to attract the armature into the coil thereby engaging the movable contact wit the stationary contact, and a reduced holding power threshold to maintain engagement of the contacts;

an arrangement in which an occurrence of a low fault current is compensated for by a contact material weld resistance;

an arrangement in which an occurrence of an intermediate fault current causes the movable contacts to separate from the stationary contacts and remain open until the movable and stationary contacts have cooled sufficiently so as to avoid contact welding; and an arrangement in which an occurrence of a high fault current causes the armature to disengage from the electromagnetic coil until application of an energy pulse achieving the activation power threshold.

13. The contactor of claim 12 having a high fault current blow open mechanism such that the movable contacts are prohibited from engaging the stationary contacts subsequent to a high fault current passing through the stationary and movable contacts.

14. The contactor of claim 1 further comprising a control that produces the first energy source to close the contactor and once closed, produces the second energy source as a pulse width modulated energy source, lower than the first energy source, to maintain closure of the contactor.

15. The contactor of claim 12 wherein the contact material composition is comprised of one of a silver oxide material, a silver tin oxide material, and a silver cadmium oxide composition.

16. The contactor of claim 1 5 wherein the contact material composition is formed by subjecting an Ag alloy to an internal oxidation treatment, or a co-extrusion process, and the tin oxide material having approximately 10% tin oxide ($SnO_2$), 2% bismuth oxide ($Bi_2O_3$), and a remainder of silver (Ag) and trace impurities.

17. The contactor of claim 12 having a set of first magnetic components located adjacent to and movable with the movable contacts, and a set of second magnetic components mounted rigidly to the movable contact carrier causing a temporary separation of the movable contacts from the stationary contacts under intermediate and high fault currents.

18. The contactor of claim 17 having a high fault current blow open mechanism to separate the movable contacts away from engaging the stationary contacts subsequent to a high fault current passing through the movable and stationary contacts until application of the energy pulse.

19. A method of preventing contact weld under fault conditions in a contactor comprising the steps of:

providing a pair of contacts comprised of one of a silver oxide material, a silver tin oxide material, and a silver cadmium oxide material wherein at least one contact is movable between a closed position and an open position with respect to a stationary contact;

energizing a coil with an energy pulse reaching an activation power threshold source to create an electrical current path through the pair of contacts when the contacts are in a closed position;

providing latching of the movable contact from the stationary contact during an intermediate fault current until the contacts have cooled sufficiently so as to avoid a welding of the movable contact to the stationary contact; and permitting disengagement of an armature from the coil under a high fault current to prohibit the movable contact from engaging the stationary contact until application of an energy pulse achieving the activation power threshold.

20. The method of claim 19 further comprising the step of providing a pair of magnetic components having a high remnant flux density to hold open the pair of contacts during an intermediate to high fault current and delaying a closing time of the movable contact until after dissipation of an intermediate fault current, one of the magnetic components being attached to the movable contact and the other attached away from the movable contact.

* * * * *